US006860491B2

(12) United States Patent
Sauter

(10) Patent No.: US 6,860,491 B2
(45) Date of Patent: Mar. 1, 2005

(54) VIBRATION DAMPENING SKATE FRAME

(75) Inventor: Tom Sauter, Seattle, WA (US)

(73) Assignee: K-2 Corporation, Vashon, WA (US)

( * ) Notice: Subject to any disclaimer, the term of this patent is extended or adjusted under 35 U.S.C. 154(b) by 0 days.

(21) Appl. No.: 09/145,381

(22) Filed: Sep. 1, 1998

(65) Prior Publication Data

US 2001/0013685 A1 Aug. 16, 2001

(51) Int. Cl.[7] ..... A63C 17/14
(52) U.S. Cl. ..... 280/11.221; 280/11.231
(58) Field of Search ..... 280/11.221, 11.223, 280/11.224, 11.225, 11.226, 11.227, 11.231, 11.233, 11.27, 11.28, 11.3

(56) References Cited

U.S. PATENT DOCUMENTS

| | | | | |
|---|---|---|---|---|
| 1,649,374 A | | 12/1927 | Colwell | |
| 1,728,629 A | | 9/1929 | Sahlmann | |
| 3,951,422 A | | 4/1976 | Hornsby | |
| 4,351,538 A | | 9/1982 | Berta | |
| 4,392,659 A | | 7/1983 | Yoshimoto | |
| 4,402,521 A | | 9/1983 | Mongeon | |
| 5,092,614 A | | 3/1992 | Malewicz | |
| 5,135,244 A | | 8/1992 | Allison | |
| 5,330,208 A | | 7/1994 | Charron et al. | |
| 5,366,232 A | * | 11/1994 | Pozzobon et al. | 280/11.22 |
| 5,398,948 A | | 3/1995 | Mathis | |
| 5,405,156 A | | 4/1995 | Gonella | |
| 5,503,413 A | | 4/1996 | Belogour | |
| 5,513,861 A | | 5/1996 | Monroy et al. | |
| 5,575,489 A | | 11/1996 | Oyen et al. | |
| 5,704,620 A | * | 1/1998 | Oilemans et al. | 280/11.22 |
| 5,720,488 A | * | 2/1998 | Foffano et al. | 280/11.22 |
| 5,775,707 A | * | 7/1998 | Hu et al. | 280/11.22 |
| 5,810,369 A | * | 9/1998 | Wilder et al. | 280/11.22 |
| 5,890,723 A | * | 4/1999 | Benoit | 280/11.22 |
| 5,890,724 A | * | 4/1999 | Gignoux et al. | 280/11.28 |
| 5,904,360 A | * | 5/1999 | Oliemans et al. | 280/11.28 |
| 5,934,692 A | * | 8/1999 | Artus | 280/11.22 |
| 5,934,693 A | * | 8/1999 | Nicoletti | 280/11.22 |
| 5,938,214 A | * | 8/1999 | Roman et al. | 280/11.22 |
| 5,947,487 A | * | 9/1999 | Keleny et al. | 280/11.22 |
| 5,951,027 A | * | 9/1999 | Oyen et al. | 280/11.22 |
| 6,010,136 A | * | 1/2000 | Hoskin | 280/11.27 |
| 6,109,623 A | * | 8/2000 | Roman et al. | 280/11.22 |
| 6,189,898 B1 | * | 2/2001 | Benoit | 280/1.221 |

FOREIGN PATENT DOCUMENTS

| | | | | |
|---|---|---|---|---|
| EP | 0848971 | * | 6/1998 | 280/11.22 |
| NL | 8004718 | | 3/1982 | |

* cited by examiner

*Primary Examiner*—Hau Phan
(74) *Attorney, Agent, or Firm*—Christensen O'Connor Johnson Kindness PLLC

(57) ABSTRACT

A skate frame (20) for an in-line skate (18) having a shoe portion (22) and a plurality of longitudinally aligned wheels (24) capable of traversing a surface. The skate frame including an elongate carrier frame (70) having first and second sidewalls (52*a* and 52*b*) held in space parallel disposition by a first upper wall. The carrier frame having an open lower end spaced to receive the wheels therebetween. The skate frame also including an elongate outer shell (66) having first and second sidewalls and an open lower end. The sidewalls of the outer shell are spaced to receive the carrier frame therein, such that the sidewalls of the outer shell overlap at least a portion of the sidewalls of the carrier frame. A shear layer (68) is disposed between the carrier frame and the outer shell to absorb at least a portion of the vibrational energy transmitted from the surface to the shoe portion when the skate traverses the surface. The sidewalls of the carrier frame and outer shell have a predetermined cross sectional shape to permit the sidewalls to flex, thereby absorbing at least a portion of the vibrational energy transmitted from the surface to the shoe portion when the skate traverses the surface.

31 Claims, 2 Drawing Sheets

VIBRATION DAMPENING SKATE FRAME

FIELD OF THE INVENTION

The present invention relates generally to skates and, in particular, to a vibration dampening skate frame.

BACKGROUND OF THE INVENTION

Traditionally, in-line roller skates generally include an upper shoe portion secured by a base to a frame that carries a plurality of longitudinally aligned wheels. The upper shoe portion provides the support for the skater's foot, while the frame rigidly attaches the wheels to the upper shoe portion. Because of the wheeled arrangement of an in-line skate, skaters usually skate on a paved surface, such as a concrete or asphalt surface. For a variety of reasons, including natural wear and tear, such surfaces are often not perfectly smooth. The common surface a skater traverses is often pitted with bumps and/or rocks. Skating on a pitted or rough pavement often results in some degree of skater discomfort as they skate for longer periods of time. One of the greatest sources of this discomfort is vibration or "foot buzz" caused by traversing the rough pavement.

Skate vibration caused by traversing a rough surface also results in premature skater fatigue. In response to the often random vibratory motion, various muscle groups of the skater must respond to absorb the energy associated with traversing a rough surface. This increased muscle activity results in otherwise unnecessary energy expenditure and, therefore, results in premature skater fatigue. Thus, a skater often suffers from various forms of discomfort and increased fatigue when skating on most common types of paved surfaces.

Prior attempts to minimize both skater discomfort and premature fatigue associated with skate vibration include skates having various types of mechanical systems to isolate the foot of the skater from vibrational energy. Such systems rely on combinations of mechanical pivot and linkage systems, together with dampeners and shock absorbers to minimize the adverse effect of vibrational energy. Although such mechanical systems reduce the adverse effects of vibrational energy, they are not without their disadvantages.

One such disadvantage is the increased ride height required to accommodate the mechanical assembly. In order to fit an adequate mechanical linkage assembly under the skater's foot, the ride height of the skate must be increased. This results in an unstable skate and, therefore, decreases biomechanical performance. Another disadvantage of mechanical suspension systems is the substantial amount of weight added to the skate because of the mechanical linkages. This is also detrimental to performance. Mechanical systems on a skate frame are subject to contamination and, therefore, may cause reduced performance or even failure of the system. Mechanical suspension systems also must be serviced to maintain reliable performance. Furthermore, inherent in a mechanical linkage suspension system is an increase in lateral and torsional flexibility of the skate frame, which is also detrimental to performance. Additionally, increased number of mechanical parts required to build a skate frame dramatically increases the cost of producing a finished skate. Finally, complex mechanical systems are often difficult for the skater and retail shop to understand, adjust, and service.

Thus, there exists a need for a skate having a relatively simple vibration dampening skate frame that not only reduces the adverse effects of vibration, but also is light-weight, economical to manufacture, and meets the performance expectations of a skater.

SUMMARY OF THE INVENTION

The present invention provides both a vibration dampening skate frame for an in-line skate and a method of construction of a vibration dampening skate frame. The in-line skate has a shoe portion and a plurality of longitudinally aligned wheels capable of traversing a surface. The skate frame includes an elongate carrier frame having first and second sidewalls held in spaced parallel disposition by a first upper wall. The carrier frame has an open lower end space to receive the wheels therebetween. The skate frame also includes an elongate outer shell having first and second sidewalls and an open lower end. The sidewalls of the outer shell are spaced to receive the carrier frame therebetween, such that the sidewalls of the outer shell overlap at least a portion of the sidewalls of the carrier frame.

In an aspect of the present invention, the sidewalls of the carrier frame and outer shell have a predetermined cross sectional shape to permit the sidewalls to flex, thereby absorbing at least a portion of the vibrational energy transmitted from the surface to the shoe portion when the skate traverses the surface.

In another aspect of the present invention, a shear layer is disposed between the carrier frame and the outer shell to absorb at least a portion of the vibrational energy transmitted from the surface to the shoe portion when the skate traverses the surface.

In yet another aspect of the present invention, the shear layer and predetermined cross sectional shape of the outer shell and carrier frame are combined to increase absorption of the vibrational energy associated with traversing a surface.

In still yet another aspect of the present invention, the wheels are journaled to the lower end of the carrier frame to further increase vibration absorption by isolating the wheels from the outer shell.

A method of constructing a vibration dampening skate frame for a skate having a shoe portion and a plurality of longitudinally aligned wheels is also provided. The method includes the step of forming a first structural member into a carrier frame having first and second sidewalls, an upper end, a lower end, a perimeter outer surface, and a perimeter inner surface. Another step in the method includes forming a second structural member into an outer shell having first and second sidewalls, an upper end, a lower end, a perimeter outer surface, and a perimeter inner surface. The method of the present invention also includes contouring the cross sectional shape of both the carrier frame and the outer shell to permit the sidewalls of both the carrier frame and outer shell to flex, thereby absorbing at least a portion of the vibrational energy transmitted from the surface to the shoe portion when the skate traverses the surface. An elastomeric shear layer is applied between the outer surface of the carrier frame and the inner surface of the outer shell, such that the shear layer is sandwiched between the outer shell and carrier frame to absorb at least a portion of the vibrational energy transmitted from the surface to the shoe portion when the skate traverses the surface.

The vibration dampening skate frame of the present invention provides several advantages over skate frames currently available in the art. The skate frame of the present invention is light-weight and has a low profile relative to the ground for good skating performance. It has no moving mechanical parts and, therefore, requires no maintenance or periodic replacement of worn or damaged parts. Also, because the skate frame of the present invention absorbs vibrational energy without mechanical parts, it requires no adjustments and is economical to produce. Thus, a vibration dampening skate frame constructed in accordance with the present invention has several advantages over frames currently available in the art.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figures 1, 2, 3, 4:
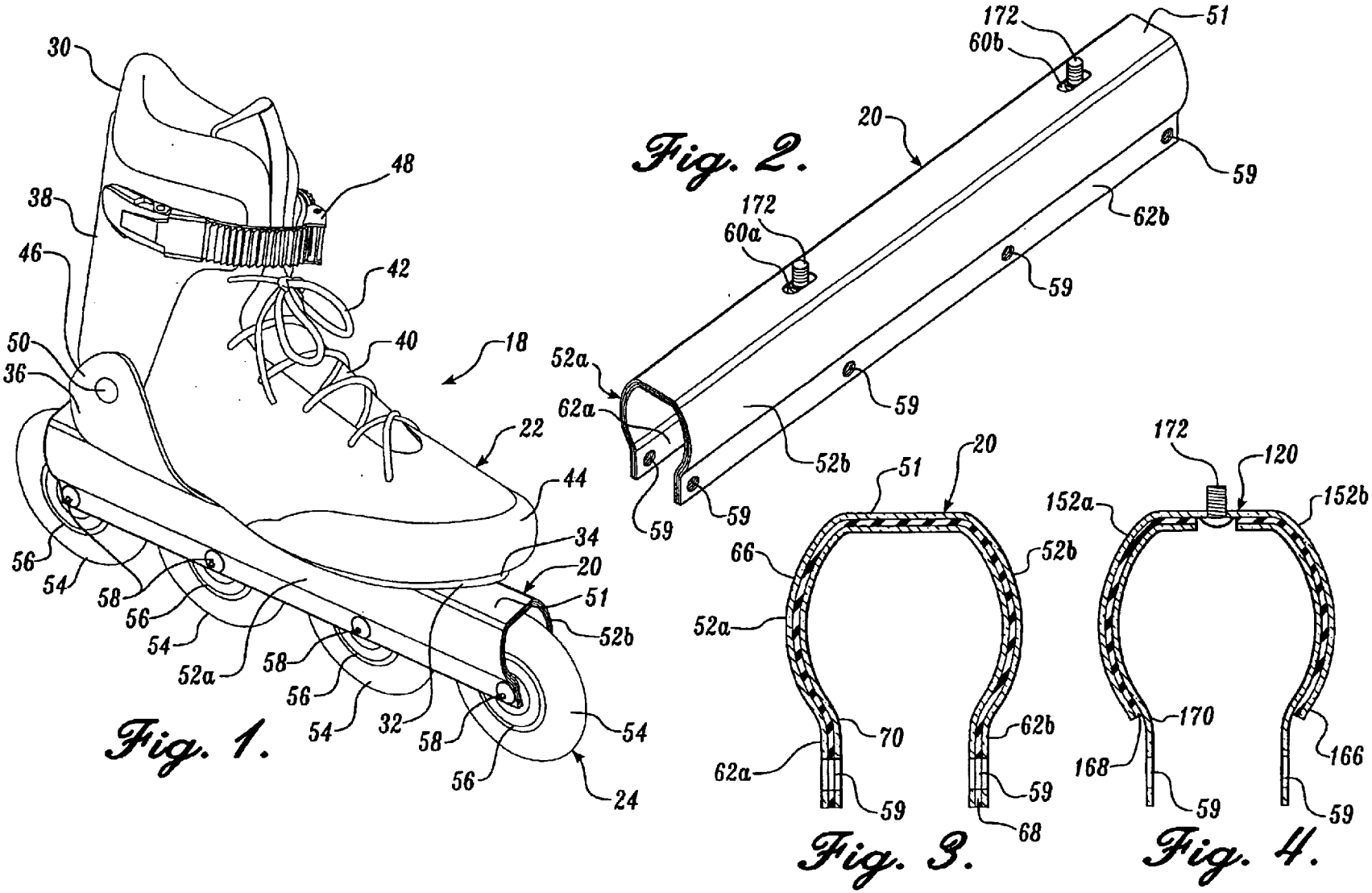
FIG. 1 is an environmental view of an in-line skate with a vibration dampening skate frame of the present invention.
FIG. 2 is a perspective view of the vibration dampening skate frame of the present invention with the wheels and shoe portion removed.
FIG. 3 is an end view of a vibration dampening skate frame of the present invention showing an elastomeric shear layer disposed between an outer shell and a carrier frame.
FIG. 4 is an end view of an alternate embodiment of a vibration dampening skate frame of the present invention showing an outer shell and an elastomeric shear layer extending partially down the sidewalls of a carrier frame.

FIG. 1 illustrates a preferred embodiment of an in-line skate 18 having a vibration dampening skate frame 20 constructed in accordance with the present invention. The skate frame 20 is shown attached to a shoe portion 22 and a bearing member in the form of a plurality of wheels 24.

The shoe portion 22 has an upper shoe portion 30, a base 32, and a cuff 38. The upper shoe portion 30 is preferably constructed from a flexible and durable natural or man-made material, such as leather, nylon fabric, or canvas. The upper shoe portion 30 also includes a conventional vamp 40 and vamp closure, including a lace 42, extending along the top of the foot from the toe area of the foot to the base of the shin of the skater. The upper shoe portion 30 is fixedly attached to the base 32 by being secured beneath a last board (not shown) by means well known in the art, such as glue or stitching.

The base 32 is constructed in a manner well-known in the art from a resilient composite material. The base 32 includes a toe end 34, a heel end 36, a toe cap 44, and a heel counter 46. Suitable materials for the base 32 include semi-rigid thermoplastic or thermal setting resins, such as carbon reinforced epoxy. The toe cap 44 surrounds the toe end of the upper shoe portion 30 and is preferably an integrally formed portion of the base 32. Alternatively, the toe cap 44 may not be used or may be formed of a different material from the rest of the base 32, such as rubber. Because the upper shoe portion 30 is preferably constructed from nylon or other flexible, natural, or man-made materials, the function of the toe cap 44 is to protect the toe end of the upper shoe portion 30 from wear and water. The toe cap 44 also extends around the lateral and medial sides of the toe end of the upper shoe portion 30 to provide additional support to the foot of the skater.

The heel counter 46 extends upwardly from the heel end 36 of the base 32. The heel counter 46 surrounds and cups the heel portion of the upper shoe portion 30 and provides lateral support for the heel of the skater. As with the toe cap 44, the heel counter 46 is preferably formed as an integral part of the base 32. Alternatively, the heel counter 46 may be constructed of a different material and attached to the base 32 by means well-known in the art, such as glue.

The cuff 38 extends upwardly from the heel counter 46, adjacent the rear and side portions of the upper shoe portion 30, such that the cuff 38 stabilizes the upper shoe portion 30 in the lateral and medial directions while allowing fore and aft flexing. For added stability, the cuff 38 includes a well-known fastener 48, such as a ratchet and strap buckle fastener, attached to the upper end of the cuff 38. The fastener 48 is located in the shin area of the skater when the skater's foot is received within the shoe portion 22 and extends between the lateral and medial sides of the cuff 38. The lower end of the cuff 38 is pivotally attached to the heel counter 46 by a pair of pivot pins 50. The pivot pin 50 extends laterally through the upper end of the heel counter 46 and laterally through the lower end of the cuff 38, thereby pinning one side of the cuff 38 to the heel counter 46. Although only the lateral side is shown in FIG. 1, the medial side is configured substantially identically to the lateral side and, therefore, a second pivot pin (not shown) attaches the medial side in the same manner previously described for the lateral side.

Referring to FIGS. 1 and 2, attention is now drawn to the vibration dampening skate frame 20. The frame 20 is preferably configured as an inverted, substantially U-shaped elongate member. The spine of the frame 20 defines an upper surface 51 and the downwardly depending sides thereof define first and second side rails 52*a* and 52*b*. The first and second side rails 52*a* and 52*b* are held in spaced parallel disposition by the upper surface 51, such that a plurality of longitudinally aligned wheels 24 are receivable therebetween. The wheels 24 are conventional roller skate wheels well known in the art. Each wheel 24 has an elastomeric tire 54 mounted on a hub 56. Each wheel 24 is journaled on bearings and is rotatably fastened between the first and second side rails 52*a* and 52*b* on an axle bolt 58. The axle bolt 58 extends between laterally aligned axle mounting holes 59 (FIG. 2) located in the lower ends of the first and second side rails 52*a* and 52*b*. The axle bolt 58 also extends laterally through rotary bearings (not shown) centrally located in the hub 56 of each wheel 24. Preferably, the wheels 24 are journaled to the frame 20 in a longitudinally aligned arrangement and are positioned substantially midway between the lateral and medial sides of the shoe portion 22.

The shoe portion 22 may be rigidly fastened to the upper surface 51 of the frame 20 by well-known fasteners (not shown), such as bolts or rivets. The fasteners extend vertically through the toe and heel ends 34 and 36 of the base 32 and into the upper surface 51 of the frame 20. As may be seen better by referring to FIG. 2, the upper surface 51 includes first and second attachment holes 60*a* and 60*b*. The attachment holes 60*a* and 60*b* extend vertically through the upper surface 51 and are located thereon such that they are substantially aligned with the toe end 34 and heel end 36 of the base 22, respectively. The attachment holes 60*a* and 60*b* are sized to receive the fasteners therethrough, thereby fastening the shoe portion 22 to the frame 20. Although it is preferred that the shoe portion 22 be rigidly fastened to the frame 20, other configurations, such as detachably attaching the shoe portion to the skate frame, are also within the scope of the present invention.

As may be seen better by referring to FIGS. 2 and 3, the first and second side rails 52*a* and 52*b* are preferably configured as elongate C-shaped members. The side rails 52*a* and 52*b* are preferably integrally formed with the upper surface 51 and depend downwardly from opposite longitudinal edges thereof, such that the concave portions of the side rails 52*a* and 52*b* face inwardly towards each other in an opposed manner. As configured, and as may be seen better by referring to FIG. 3, the first and second side rails 52*a* and 52*b* have an arcuate cross section and form a tube-like structure. Integrally formed with the lower ends of the first and second side rails 52*a* and 52*b* are first and second wheel attachment flanges 62*a* and 62*b*. The first and second wheel attachment flanges 62*a* and 62*b* are rectangular in shape and extend downwards from the lower ends of the arcuate cross section of the side rails 52*a* and 52*b*.

Although it is preferred that the side rails have an arcuate cross section, other configurations, such as a triangular cross sectional shape with downwardly depending wheel attachment flanges, are also within the scope of the invention. Furthermore, although it is preferred that the side rails have an arcuate cross section that protrudes outwardly, other configurations are also within the scope of the invention. As a first non-limiting example, the side rails may have an indenting cross section, wherein the concave portions of the side rails face outwardly from each other. In a second non-limiting example, the side rails may be corrugated to form at least one protrusion and at least one indention in each side rail. Thus, while the direction and shape of the arcuate sections of the side rails is not essential for the present invention, it is preferred that the side rails form a post buckled structure, wherein the side rails flex in response to a load associated with traversing a surface, as is described in greater detail below. However, while a post buckled structure is preferred, it is not required. As a non-limiting example, the side rails may depend substantially straight down from the upper surface 51, such that the frame 20 has a substantially U-shaped cross section. Therefore, a frame with side rails having either a straight or arcuate cross section is within the scope of the present invention.

Still by referring to FIG. 3, the frame 20 is a laminate structure having an outer shell 66, a shear layer 68, and a carrier frame 70. The outer shell 66 and carrier frame 70 are preferably constructed in a manner well known in the art from a light-weight and high-strength material, such as metal or a fiber reinforced polymer composite. The shear layer 68 is an elastomer that may be applied to the premolded carrier frame 70 or injected between the preassembled carrier frame 70 and outer shell 66, as is described in greater detail below.

In the preferred method of constructing the frame 20, the outer shell 66 and carrier frame 70 are premolded into the cross sectional shape described above and, therefore, each has an upper surface and downwardly depending first and second side rails. The carrier frame 70 is sized to be received between the side rails of the outer shell 66, such that the side rails of the outer shell 66 encase the entire perimeter of the carrier frame 70. Thus, the cross sectional width of the outer shell 66 is slightly larger than the cross sectional width of the carrier frame 70.

After the outer shell 66 and carrier frame 70 have been molded into the desired shape, and before the carrier frame 70 is received within the outer shell 66, an uncured elastomeric shear layer 68 is applied to the entire outside perimeter of the carrier frame 70, such that the shear layer 68 coats the outside of the carrier frame 70. The side rails of the outer shell 66 are spread outwardly away from each other such that the outer shell 66 may receive the carrier frame 70 coated with the uncured shear layer 68 therein. As assembled, the elastomeric shear layer 68 is allowed to cure, thereby fastening the carrier frame 70 within the outer shell 66.

In an alternate method of constructing the frame 20 of the present invention, the carrier frame 70 may be premolded as described above, while the outer shell 66 may be applied as a wet composite material to the carrier frame 70. In this alternate embodiment, the uncured elastomeric shear layer 68 is applied to the outside perimeter of the carrier frame 70 as described above. The wet outer shell composite material may then be applied to the shear layer 68 such that when the shear layer 68 and outer shell 66 harden, they both conform to the shape of the carrier frame 70 and the shear layer 68 is sandwiched between the outer shell 66 and carrier frame 70.

In still yet another alternate method of constructing the frame 20 of the present invention, the outer shell 66 and carrier frame 70 may be premolded as described above and assembled such that a gap exists between the outer shell 66 and carrier frame 70. An uncured elastomeric shear layer 68 may be injected into the gap, such that when the shear layer 68 hardens, it bonds to the inside surface of the outer shell 66 and the outside surface of the carrier frame 70.

Referring to FIGS. 1 and 3, attention is now directed to the operation of the frame 20. As the in-line skate 18 traverses a surface, the wheels 24 may encounter a variety of protuberances and recesses that cause the skate to vibrate. As each wheel 24 encounters a particular disturbance, the wheel 24 transfers a load to the axle 58. In turn, because the axle 58 is attached to the frame 20 as described above, it applies a load to the frame 20. Because of the arcuate cross sectional shape of the side rails 52*a* and 52*b*, the side rails 52*a* and 52*b* have an inherent predisposition to flex in response to the load. By flexing, the side rails 52*a* and 52*b* absorb at least a portion of the vibrational energy associated with traversing a surface. Thus, instead of all the vibrational energy being transmitted from the wheels 24 to the shoe portion 22, a portion of the vibrational energy is absorbed by the frame 20 as it flexes.

The elastomeric shear layer 68 also absorbs at least a portion of the vibrational energy transmitted from traversing the surface. By layering an elastomeric shear layer 68 between the outer shell 66 and carrier frame 70, this construction takes advantage of an elastomer's inherent quality of dissipating vibrational energy best in shear. Although it is preferred that the shear layer 68 be used in combination with the arcuate cross sectional shape of the side rails 52*a* and 52*b*, it is not necessary to combine these two aspects of the present invention and, therefore, individual use of one aspect without the second is also within the scope of the invention.

Although extending the outer shell 66 to the lower end of the carrier frame 70 is the preferred embodiment, as seen in FIG. 4, at least one alternate embodiment of the frame 20 is also within the scope of the present invention. As seen in FIG. 4, the sidewalls 152*a* and 152*b* of the outer shell 166 extend only partially down the sidewalls of the carrier frame 170. The shear layer 168 also extends only partially down the sidewalls of the carrier frame 170, such that the outer shell 166 and shear layer 168 both extend downwardly to the base of the outwardly curved sections of the side rails 152*a* and 152*b*. In this alternate embodiment, the wheels of the skate are attached only to the lower end of the carrier frame 170, thereby increasing the vibrational energy absorption aspect of the frame 120 by completely separating the wheel assembly from the outer shell 166 and the shear layer 168. By attaching the wheels to the carrier frame, the vibrational energy associated with traversing a surface must first pass through the elastomeric shear layer and the arcuate cross sectional shape of both the carrier frame and the outer shell, thereby eliminating a direct load path to the shoe portion.

The shoe portion may be further isolated from vibration associated with traversing a surface by limiting the attachment of the shoe portion to only the outer shell 166. As seen in FIG. 4, the carrier frame 170 and the elastic layer 168 do not extend into the area adjacent the perimeter of the attachment holes 60*a* and 60*b* (FIG. 1). The shoe portion is fastened to the frame 120 by a shoe attachment bolt 172 extending through the attachment hole without contacting either the elastic layer 168 or the carrier frame 170, thereby eliminating a direct load path to the shoe portion. Operation of this alternate embodiment of the frame 120 is identical to that described above for the preferred embodiment, except that the wheels are isolated from the outer shell to further isolate the vibrational energy from the shoe portion.

Figure 5:
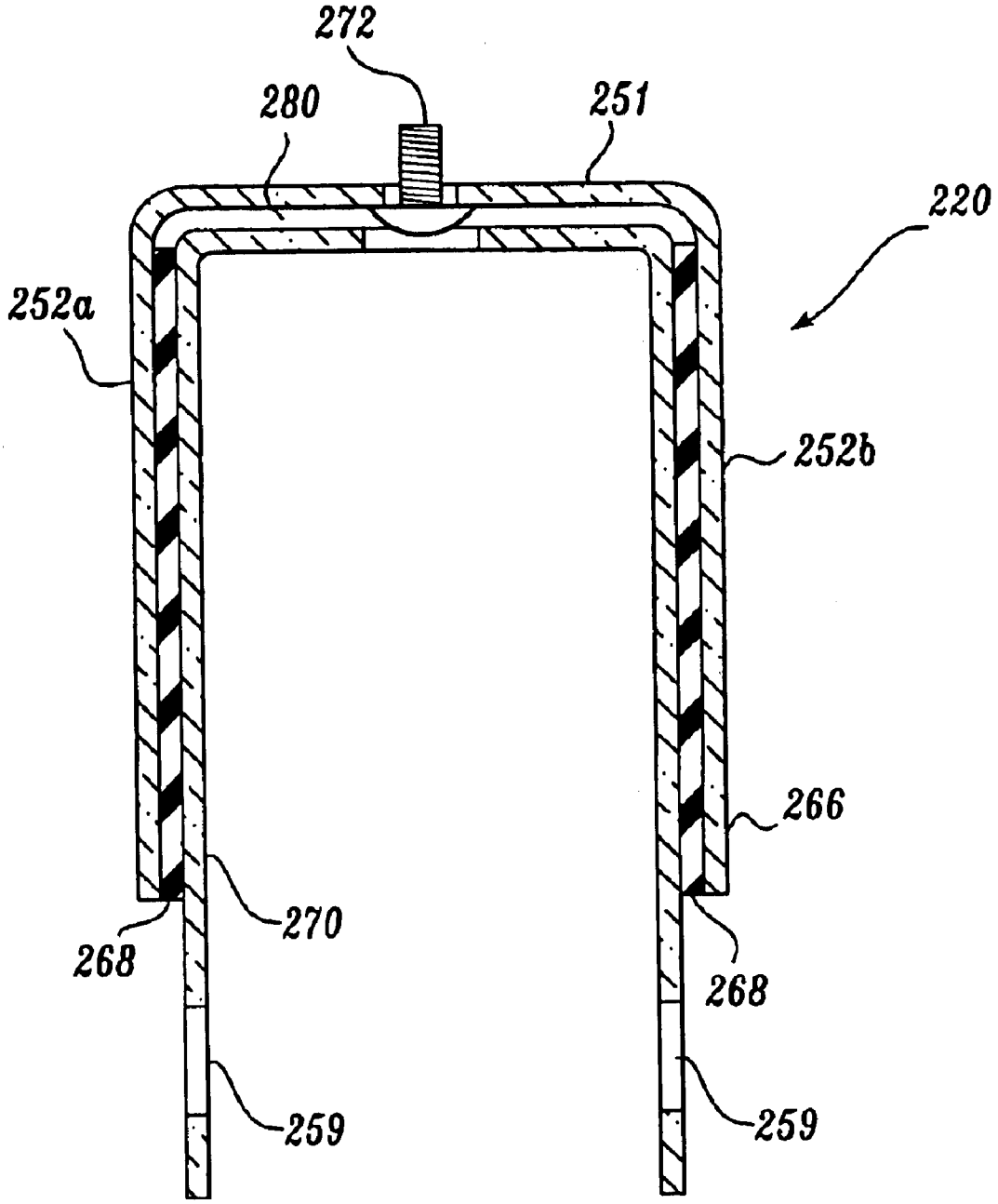
FIG. 5 is an end view of a second alternate embodiment of a vibration dampening skate frame of the present invention showing a gap between the outer shell and the carrier frame.

Referring to FIG. 5, a second alternate embodiment of the skate frame 220 will now be described in greater detail. The second alternate embodiment is configured and constructed substantially identically to the first alternate embodiment of FIG. 4, except for the following difference. As seen in FIG. 5, there is a gap 280 between the carrier frame 270 and the outer shell 266 and extends between the upper ends of the shear layer 268. The shear layer 268 is disposed within the first and second sidewalls 252*a* and 252*b* and extends from the lower ends of the outer shell 266 to the upper ends of the sidewalls 252*a* and 252*b*. Thus, the gap 280 extends between the upper ends of the shear layer 268 and is located between the outer shell 266 and carrier frame 270 in the area of the upper surface 251.

In operation, when vibration surface is encountered, the gap 280 absorbs at least a portion of the vibration by compressing the space defined by the gap 280. Although it is preferred that the gap 280 is void of materials, other configurations, such as filling the gap 280 with an elastomer, are also within the scope of the present invention.

The previously described versions of the present invention provide several advantages over skates currently available in the art. The skate to the present invention is lightweight and has a low profile relative to the ground for good skating performance. It has no moving mechanical parts and, therefore, requires no maintenance or periodic replacement of worn or damaged parts. Also, because the skate frame of the present invention absorbs vibrational energy without the mechanical parts, it requires no adjustments and is economical to produce. Thus, the present invention offers a skate having a predetermined cross sectional shape and/or an elastomeric shear layer to absorb at least a portion of the vibrational energy associated with traversing a rough surface.

From the foregoing description, it may be seen that the skate of the present invention incorporates many novel features and offers significant advantages over the prior art. It will be apparent to those of ordinary skill that the embodiments of the invention illustrated and described herein are exemplary only and, therefore, changes may be made to the foregoing embodiments. As a non-limiting example, portions of the frame 20 could be cut out above or between the wheels 24 to further increase or tune the vibrational energy absorption of the frame. Thus, it may be appreciated that various changes can be made to the preferred embodiment of the invention without departing from the spirit and scope of the invention.

The embodiments of the invention in which an exclusive property or privilege is claimed are defined as follows:

1. A skate frame for an in-line skate, the skate having a shoe portion and a plurality of wheels capable of traversing a surface, the skate frame comprising:

(a) an elongate first structural member having first and second sidewalls depending downwardly from a first upper surface, the lower ends of the sidewalls being spaced to receive the wheels therebetween; and (b) flexible vibration dampening means integrally formed with the sidewalls of the first structural member for absorbing at least a portion of vibrational energy transmitted from the surface to the shoe portion when the skate traverses the surface, wherein the flexible vibration dampening means comprises a contoured portion of each of the first and second sidewalls of the first structural member, the contoured portion having a predetermined cross sectional shape to permit the sidewalls to flex, thereby absorbing at least a portion of the vibrational energy associated with traversing the surface, wherein the flexible vibration dampening means are not removable.

2. The skate frame of claim 1, wherein the cross sectional shape of the first and second sidewalls is substantially arcuate, such that the contoured portion of the sidewalls flexes to absorb at least a portion of the vibrational energy.

3. The skate frame of claim 2, wherein the arcuate cross sectional shape of the first and second sidewalls is substantially C-shaped in configuration, the arcuate cross sectional shape having an upper end spaced from a lower end by a concave portion.

4. The skate frame of claim 3, wherein the concave portion of the first sidewall faces the concave portion of the second sidewall in an opposed manner, such that the first structural member is tubular.

5. The skate frame of claim 1, further comprising a second structural member having first and second sidewalls held in spaced parallel disposition by a second upper wall, the second structural member having an open lower end sized to receive the wheels therebetween, the second structural member having a width sized to be received within the first structural member such that the sidewalls of the first structural member overlap at least a portion of the sidewalls of the second structural member.

6. The skate frame of claim 5, wherein the flexible vibration dampening means comprises a contoured portion of each of the first and second sidewalls of the first structural member, the contoured portion having a predetermined cross sectional shape to permit the sidewalls to flex, thereby absorbing at least a portion of the vibrational energy associated with traversing the surface.

7. The skate frame of claim 6, wherein the cross sectional shape of the sidewalls of the first and second structural members is substantially arcuate, such that the arcuate cross sectional shape of the sidewalls flexes to absorb at least a portion of the vibrational energy, wherein the arcuate cross sectional shape of the first and second sidewall is substantially C-shaped in configuration, the arcuate cross sectional shape of each sidewall has an upper end spaced from a lower end by a concave portion.

8. The skate frame of claim 7, wherein the concave portion of the first sidewall of the first and second structural members faces the concave portion of the second sidewall of the first and second structural members in an opposed manner.

9. The skate frame of claim 8, further comprising an elastomeric shear layer disposed between the first and second structural members when the first structural member is received within the second structural member, the shear layer absorbs at least a portion of the vibrational energy transmitted from the surface to the shoe portion when the skate traverses the surface.

10. The skate frame of claim 7, wherein the sidewalls of the first structural member extend to the lower end of the arcuate cross sectional shape of the second structural member.

11. The skate frame of claim 10, further comprising rectangular first and second wheel attachment flanges depending downwardly from the lower ends of the arcuate cross sectional shape of the second structural member, wherein the wheels are journaled to the wheel attachment flanges to increase the vibration energy absorption by isolating the wheels from the first structural member.

12. The skate frame of claim 5, further comprising an elastomeric shear layer disposed between the first and second structural members when the first structural member is received within the second structural member, the shear layer absorbs at least a portion of the vibrational energy transmitted from the surface to the shoe portion when the skate traverses the surface.

13. A skate frame for an in-line skate, the skate having a shoe portion and a plurality of wheels capable of traversing a surface, the skate frame comprising:

(a) an elongate first structural member having downwardly depending first and second sidewalls, the lower ends of the sidewalls being spaced to receive the wheels therebetween;

(b) an elongate second structural member having downwardly depending first and second sidewalls, the sidewalls of the second structural member being spaced to receive the first structural member therebetween, such that the sidewalls of the second structural member overlap at least a portion of the sidewalls of the first structural member; and (c) a vibration dampening member integrally formed with the sidewalls of the first and second structural members for reducing the amount of vibrational energy transmitted from the surface to the shoe portion when the skate traverses the surface, wherein the vibration dampening member is flexible, thereby absorbing at least a portion of the vibrational energy associated with traversing the surface.

14. The skate frame of claim 13, wherein the vibration dampening member comprises contouring the sidewalls of both the first and second structural members to a predetermined cross sectional shape to permit the sidewalls to flex.

15. The skate frame of claim 14, wherein the cross sectional shape of the sidewalls of the first and second structural members is substantially arcuate, such that the arcuate cross sectional shape of the sidewalls flexes to absorb at least a portion of the vibrational energy, wherein the arcuate cross sectional shape of the first and second sidewalls of the first and second structural members is substantially C-shaped in configuration, the arcuate cross section of each sidewall has an upper end spaced from a lower end by a concave portion.

16. The skate frame of claim 15, further comprising an elastomeric shear layer disposed between the first and second structural members when the first structural member is received within the second structural member, the shear layer absorbs at least a portion of the vibrational energy transmitted from the surface to the shoe portion when the skate traverses the surface.

17. The skate frame of claim 16, wherein the sidewalls of the first structural member extend to the lower end of the arcuate cross sectional shape of the second structural member.

18. The skate frame of claim 17, further comprising rectangular first and second wheel attachment flanges depending downwardly from the lower ends of the arcuate cross sectional shape of the second structural member, the wheels are journaled to the wheel attachment flanges to increase the vibration energy absorption by isolating the wheels from the first structural member.

19. A skate frame for an in-line skate, the skate having a shoe portion and a plurality of longitudinally aligned wheels capable of traversing a surface, the skate frame comprising:

(a) an elongate carrier frame having first and second sidewalls held in spaced parallel disposition by a first upper wall and an open lower end spaced to receive the wheels therebetween;

(b) an elongate outer shell having first and second sidewalls and an open lower end, the sidewalls of the outer shell being spaced to receive the carrier frame therebetween such that the sidewalls of the outer shell overlap at least a portion of the sidewalls of the carrier frame, the sidewalls of the carrier frame and the outer shell having a predetermined cross sectional shape to permit the sidewalls to flex, thereby absorbing at least a portion of the vibrational energy transmitted from the surface to the shoe portion when the skate traverses the surface; and (c) an elastomeric shear layer disposed between the carrier frame and the outer shell when the carrier frame is received within the outer shell, the shear layer absorbs at least a portion of the vibrational energy transmitted from the surface to the shoe portion when the skate traverses the surface.

20. The skate frame of claim 19, wherein the cross sectional shape of the sidewalls of the carrier frame and the outer shell is substantially arcuate, such that the arcuate cross sectional shape of the sidewalls flexes to absorb at least a portion of the vibrational energy, wherein the arcuate cross sectional shape of first and second sidewalls of the carrier frame and the outer shell is substantially C-shaped in configuration, the arcuate cross section of each sidewall has an upper end spaced from a lower end by a concave portion.

21. The skate frame of claim 20, wherein the sidewalls of the first structural member extend to the lower end of the arcuate cross sectional shape of the second structural member.

22. The skate frame of claim 21, further comprising rectangular first and second wheel attachment flanges depending downwardly from the lower ends of the arcuate cross sectional shape of the carrier frame, the wheels are journaled to the wheel attachment flanges to increase the vibration energy absorption by isolating the wheels from the outer shell.

23. A skate frame for an in-line skate, the skate having a shoe portion and a plurality of longitudinally aligned wheels capable of traversing a surface, the skate frame comprising:

(a) an elongate outer shell having first and second sidewalls and an open lower end;

(b) an elongate carrier frame having first and second sidewalls, the sidewalls of the outer shell are spaced to receive the carrier frame therebetween such that the sidewalls of the outer shell overlap at least a portion of the sidewalls of the carrier frame; and (c) an elastomeric shear layer disposed between the carrier frame and the outer shell to absorb at least a portion of the vibrational energy transmitted from the surface to the shoe portion when the skate traverses the surface.

24. The skate frame of claim 23, wherein the carrier frame further comprises a first upper wall and an open lower end spaced to receive the wheels therebetween.

25. The skate frame of claim 24, wherein the cross sectional shape of the sidewalls of the carrier frame and the outer shell is substantially arcuate, such that the arcuate cross sectional shape of the sidewalls flexes to absorb at least a portion of the vibrational energy, wherein the arcuate cross sectional shape of first and second sidewalls of the carrier frame and the outer shell is substantially C-shaped in configuration, the arcuate cross section of each sidewall has an upper end spaced from a lower end by a concave portion.

26. The skate frame of claim 23, wherein the shoe portion is attached to the outer shell of the skate frame by an attachment bolt extending through the outer shell without contacting either the carrier frame or the elastomeric layer to limit the amount of vibrational energy transmitted to the shoe portion.

27. The skate frame of claim 26, wherein the wheels are attached to the carrier frame to further limit the amount of vibrational energy transmitted to the shoe portion.

28. The skate frame of claim 23 comprising a gap extending between the outer shell and the carrier frame to absorb at least a portion of the vibrational energy transmitted to the shoe portion.

29. A method of constructing a vibration dampening skate frame for a skate having a shoe portion and a plurality of longitudinally aligned wheels capable of traversing a surface, the method comprising:

(a) providing a tubular carrier frame having first and second sidewalls, a perimeter outer surface, and a perimeter inner surface;

(b) contouring the cross sectional shape of the carrier frame to permit the sidewalls of the carrier frame to flex, thereby absorbing at least a portion of vibrational energy transmitted from the surface to the shoe portion when the skate traverses the surface;

(c) providing a tubular outer shell having first and second sidewalls, a perimeter outer surface, and a perimeter inner surface;

(d) contouring the cross sectional shape of the outer shell to permit the sidewalls of the outer shell to flex, thereby absorbing at least a portion of vibrational energy transmitted from the surface to the shoe portion when the skate traverses the surface;

(e) applying an elastomeric shear layer to the outer surface of the carrier frame; and (f) placing the carrier frame within the outer shell such that the shear layer is sandwiched between the outer shell and carrier frame to absorb at least a portion of vibrational energy transmitted from the surface to the shoe portion when the skate traverses the surface.

30. A method of constructing a vibration dampening skate frame for a skate having a shoe portion and a plurality of longitudinally aligned wheels capable of traversing a surface, the method comprising the steps of:

(a) forming a first structural member into a carrier frame having first and second sidewalls, an upper end, a lower end, a perimeter outer surface, and a perimeter inner surface;

(b) forming a second structural member into an outer shell having first and second sidewalls, an upper end, a lower end, a perimeter outer surface, and a perimeter inner surface;

(c) integrally forming a vibration dampening member with the sidewalls of both the carrier frame and the outer shell to absorb at least a portion of vibrational energy transmitted from the surface to the shoe portion; and (d) inserting the carrier frame into the outer shell such that the vibration dampening member is positioned between the upper and lower ends thereof to absorb at least a portion of the vibrational energy transmitted from the surface to the shoe portion as the skate traverses the surface.

31. A skate frame for an in-line skate, the skate having a shoe portion and a plurality of wheels capable of traversing a surface, the skate frame comprising:

(a) an elongate first structural member having first and second sidewalls depending downwardly from a first upper surface, the lower ends of the sidewalls being spaced to receive the wheels therebetween;

(b) flexible vibration dampening means integrally formed with the sidewalls of the first structural member for absorbing at least a portion of vibrational energy transmitted from the surface to the shoe portion when the skate traverses the surface; and (c) a second structural member having first and second sidewalls held in spaced parallel disposition by a second upper wall, the second structural member having an open lower end sized to receive the wheels therebetween, the second structural member having a width sized to be received within the first structural member such that the sidewalls of the first structural member overlap at least a portion of the sidewalls of the second structural member.

* * * * *

UNITED STATES PATENT AND TRADEMARK OFFICE

CERTIFICATE OF CORRECTION

PATENT NO. : 6,860,491 B2
DATED : March 1, 2005
INVENTOR(S) : T. Sauter

It is certified that error appears in the above-identified patent and that said Letters Patent is hereby corrected as shown below:

Column 9,
Line 6, "claim 7," should read -- claim 9, --.

Signed and Sealed this

Ninth Day of May, 2006

JON W. DUDAS
*Director of the United States Patent and Trademark Office*